US005284504A

United States Patent [19]

Barker et al.

[11] Patent Number: 5,284,504

[45] Date of Patent: Feb. 8, 1994

[54] POWDERED DESULFURIZING REAGENT AND PROCESS OF USE

[75] Inventors: Bruce J. Barker; Brian M. Kinsman; Ian A. Cameron, all of Ontario, Canada

[73] Assignee: The Carbide/Graphite Group, Inc., Pittsburgh, Pa.

[21] Appl. No.: 966,223

[22] Filed: Oct. 26, 1992

[30] Foreign Application Priority Data

Oct. 25, 1991 [CA] Canada ..... 2,054,244-6

[51] Int. Cl.[5] ..... C21C 7/02

[52] U.S. Cl. ..... 75/312

[58] Field of Search ..... 75/312

[56] References Cited

U.S. PATENT DOCUMENTS

| | | | |
|---|---|---|---|
| 4,194,902 | 3/1980 | Gmohling | 75/312 |
| 4,260,413 | 4/1981 | Freissmuth | 75/312 |
| 4,764,211 | 8/1988 | Meichsner | 75/312 |

*Primary Examiner*—Peter D. Rosenberg

*Attorney, Agent, or Firm*—Barry I. Friedman

[57] ABSTRACT

A reagent for desulfurizing molten iron comprising calcium carbide and/or lime and an asphaltite. The reagent may contain, in addition, magnesium which is either uniformly distributed within the reagent mixture, or stored separately and added to the mixture during fluidized transport of the reagent just prior to injection to vary the addition of magnesium for any given injection.

24 Claims, No Drawings

POWDERED DESULFURIZING REAGENT AND PROCESS OF USE

BACKGROUND OF THE INVENTION

This invention relates to reagents for the desulphurization of iron melts such as pig iron and cast iron and the use of the reagent for said purpose.

The desulfurization of molten iron, outside a blast furnace, in the open ladle or in the torpedo is well known to those skilled in the art. Calcium carbide or lime-based mixtures have been used as reagents for many years and have been found to be efficient with respect to causing rapid and significant removal of the sulfur from the iron.

Most recently, specific reagents have been disclosed in U.S. Pat. Nos. 4,764,211 and 4,832,739 as containing from about 50–98 percent, by weight, of calcium carbide and 2–50 percent, same basis, of a dried coal which contains at least 15 percent, by weight, of volatile components and which evolves a gas volume of at least 80 standard liters of gas/kg of coal. This prior art product is described as not introducing further slag-forming components into the iron melt, evolving an adequate amount of gas for the dispersion of the calcium carbide, possessing advantageous consumption values, causing short treatment times and resulting in high sulfur removal.

SUMMARY OF THE INVENTION

A novel reagent for the desulfurization of molten iron has been discovered which is based on calcium carbide and/or lime and which contains, as a gas generating component, an asphaltite. The reagent is chemically engineered to maximize the desulfurizing efficiency of all its components. Since the asphaltite is available as a fine powder, it may be mixed with the other component(s) without milling. Its use is therefore less of a safety hazard than a milled mixture of calcium carbide and/or lime and coal which, due to the temperatures generated during milling, may spontaneously combust when exposed to air.

The use of an asphaltite for gas generation is advantageous over volatile coals in that it contains considerably less oxygen. The corresponding decrease in the oxygen available upon volitalization substantially increases the reagent's desulphurization efficiency. The higher percentages of hydrogen and free carbon in the asphaltites also provide an enhanced environment in the gas generated plume for deoxidization of the hot metal. Additionally, the asphaltites typically contain less sulphur and fixed carbon than volatile coals. These differences act to increase the reagent's desulphurizing efficiency by minimizing sulphur input and to decrease slag production by minimizing the fixed carbon remaining in the kish. The higher percentage of volatiles in the asphaltites (approximately 85 percent) relate to lower addition levels required for equivalent mixing as provided by the volatile coals (approximately 40 percent). This naturally leads to the production of lower slag quantities as increased levels of desulfurizing components can then be utilized to decrease the overall quantities of reagent required for equivalent desulphurization.

As is mentioned in previous patents, it is considered advantageous to have the volatile contents of the gas generator released as quickly as possible upon contact with the molten bath. Gilsonite in particular, has been shown in explosion tests to have a maximum rate of pressure rise of 3,700 psi per second as compared to 2,300 psi per second for 37 percent volatile coal. This attribute is considered advantageous in improving the distribution of the desulphurizer immediately upon immersion into the molten iron.

DESCRIPTION OF THE INVENTION INCLUDING PREFERRED EMBODIMENTS

The compositions of the present invention are based on either lime or calcium carbide as the primary component and an asphaltite as the hydrocarbon gas generating component, although both lime and calcium carbide may be used in some compositions. They preferably also contain magnesium. As such, the components are broadly contained in the compositions in the following concentrations:

| | Percent |
|---|---|
| Calcium carbide | 0–99.9 |
| Asphaltite | 0.1–40 |
| Magnesium | 0–40 |
| Lime | 0–90 |

All percentages are by weight, based on the total weight of the composition, the total weight being 100 percent.

The term "calcium carbide", as used herein, is meant to include industrial calcium carbide which is generally understood to be a product which contains 65–85 percent, by weight, of $CaC_2$ and the remainder of which is primarily lime. The amount of the calcium carbide component of the compositions of the present invention which are based primarily on calcium carbide can vary from about 1 to about 99.9 percent, by weight. Preferably, the reagent contains from about 60 to about 99.9 percent, by weight, of calcium carbide and from about 0.1 to about 40 percent, by weight, of asphaltite. Lime may additionally be added as required up to 98.9 percent.

When the compositions of the present invention do not include calcium carbide, the amount of lime present should range from about 20 to about 98.9 percent, by weight. From about 0.1 to about 40 percent, by weight of asphaltite, and from about 5.0 to about 40 percent, by weight, of magnesium are also present.

The carbide-based reagents preferably contain magnesium. Amounts of magnesium employed range from about 1 to about 40 percent, by weight, preferably about 2 to about 20 percent, and amounts of lime, added extraneously, range from about 1 to about 98.9 percent, preferably about 4 to about 30 percent, by weight. A most preferred composition comprises from about 40 to about 80 percent, by weight of technical calcium carbide, from about 4 percent to about 30 percent, by weight, of lime, from about 2 to about 20 percent, by weight, of magnesium and from about 1 to about 10 percent, by weight, of asphaltite.

Asphaltites are solid, very lowly fusible components of carbon disulfide soluble bitumens. Gilsonite, grahamite, and manjak are known species.

Gilsonite (uintaite), grahamite, and manjak are natural hydrocarbon substances which occur as solids and are mined much like other minerals. Since they are natural materials and not manufactured products, they are subject to variations, however, gilsonite generally has a Specific Gravity at 25° C. of 1.01–1.10, a Softening Point, ring and ball method, of 132°–190° C., a Fixed Carbon of 10–20 percent, a Hardness of 2 on the Moh's scale and a Penetration (77° F.) of 0–3. Its ultimate analysis (wt percent) is carbon 85.5; hydrogen 10.0; sulfur 0.3; nitrogen 2.5; oxygen 1.5; ash 0.36 percent.

Grahamite, when substantially free of mineral matter, generally has a Specific Gravity at 25° C. of 1.15–1.20, a Softening Point, ring and ball method, of 188°–329° C., a Fixed Carbon of 35–55 percent, a Hardness of 2 on the Mohs scale and a Penetration (77° F.) of 0. Its ultimate analysis (weight percent) is carbon 86.6, hydrogen 8.6, sulfur 1.8, nitrogen 2.2 and oxygen 0.7 (by difference).

Manjak is not so precisely characterized.

Of the asphaltites, gilsonite is the most preferred.

Any magnesium in particulate form may be used in the instant compositions, however, it is preferred that it have a grain size of 1 mm or less, preferably 500 μm or less, most preferably 350 μm or less. The magnesium may be supplied as pure magnesium or as secondary magnesium from a scrap reclamation process. This material may have some aluminum metal associated with it. Alternatively, the magnesium may be supplied for mixing as a lime-magnesium blend where 10–25 percent lime typically may be added to the fine-grained magnesium to passivate its explosive characteristics for easier transportation and storage.

The lime, i.e. calcium oxide, is that used in desulfurizing reagents and is well known to the skilled artisan. It is used in addition to that already combined with the industrial calcium carbide in the carbide-based compositions. It too should be of small particle size, i.e. less than 350 μm. This not only increases the surface area of the material for advantageous desulphurization properties, but also acts to provide a more uniform mixture when blended together with the other components in the reagent.

To facilitate a uniform mixture and enhance the transport and injection properties of the reagent, a flow aid may be added to the individual components of the reagent before blending and/or to the reagent as a whole. This flow aid may typically consist of a silicone, glycol or alcohol based liquid which is applied to the material in quantities ranging from 0.1 to 2 percent, by weight.

Other extraneous additives may also be incorporated into the reagent compositions as is known in the art. Thus, from about 1–10 percent, by weight, of fluorspar may be added to improve slag properties. Aluminum oxide as alumina or aluminum dross containing up to about 30 percent aluminum may replace the fluorspar in whole or in part. Additionally, slag modifying additives based on boron, such as oxides of boron, especially $B_2O_3$, or anhydrous sodium tetraborate (borax) may be used to replace fluorspar, in whole or in part.

Metallic additions made extraneously may be incorporated into the mixture to enhance the desulphurization reaction and/or to effect shape control of the resulting sulphide precipitate. These metallic additions include calcium and rare earth metals (mischmetal).

The compositions of the present invention may be prepared by mixing the components, any of which may have been pre-crushed or pre-ground, to form a uniform distribution of each component within the bulk of the reagent. For those mixtures that contain calcium carbide, the carbide is typically ground in a mill to the extent that the particle size is 90 percent, by weight, passing 200 mesh. The magnesium and asphaltite present in the reagent should be finely sized to assist in attaining and maintaining a uniform distribution of each within the mix. The fine size is not required for these components to provide a large reactive surface area, however, as their reactions within the liquid metal occur in the gaseous phase.

The process of using the above-described reagents comprises adding the reagent to the molten metal, such as by injecting it in a fluidized form by means of a carrier gas to a level as deep as possible within the molten iron. The reagent may be injected as a whole for providing the same mixture throughout the injection, or may be injected as separately stored and fluidized components in order to vary the blend chemistry throughout the course of the injection. A sequential injection may then be applied to the metal wherein any component of the aforementioned mixtures may be used either consistently or in varying percentages to effect the final sulphur level required.

The injection process generally involves delivering the materials into the molten iron at a solids flow rate of 10 to 150 kgs. per minute with a transport gas level of 3–30 standard liters of gas per kg. reagent. The solids feed rate preferably is 30–80 kgs. per minute. The carrier gases used may be argon, nitrogen, air, carbon dioxide, hydrocarbon gases or any mixtures thereof.

The following examples are set forth for purposes of illustration only and are not to be construed as limitations on the present invention unless otherwise specified. All parts and percentages are by weight unless otherwise specified.

EXAMPLE 1

Reagent, in powder form, is injected into 400 parts of molten iron at an argon gas pressure of 5 psi and a gas flow rate of 20 standard cubic feet per minute which results in about 0.1 part per minute of solids flow of reagent. The temperature is 1350° C. The total amount of reagent is about 1.6 parts. The results are set forth in Table 1, below.

TABLE 1

| Reagent | Reagent Injected Parts | Sulfur (%) |
|---|---|---|
| A | 0.0 | 0.038 |
| | 0.2 | 0.031 |
| | 0.4 | 0.024 |
| | 0.6 | 0.020 |
| | 0.78 | 0.013 |
| | 0.98 | 0.010 |
| | 1.18 | 0.007 |
| B | 0.0 | 0.058 |
| | 0.2 | 0.052 |
| | 0.38 | 0.045 |
| | 0.57 | 0.039 |
| | 0.78 | 0.035 |
| | 0.98 | 0.031 |
| | 1.18 | 0.024 |
| | 1.38 | 0.026 |
| B | 0.0 | 0.035 |
| | 0.22 | 0.028 |
| | 0.42 | 0.023 |
| | 0.63 | 0.018 |
| | 0.89 | 0.014 |
| | 1.18 | 0.013 |
| | 1.34 | 0.012 |
| | 1.58 | 0.011 |
| C | 0.0 | 0.040 |
| | 0.24 | 0.034 |
| | 0.44 | 0.024 |
| | 0.70 | 0.014 |
| | 0.95 | 0.007 |
| | 1.18 | 0.004 |
| | 1.42 | 0.003 |
| C | 0.0 | 0.060 |
| | 0.2 | 0.058 |
| | 0.36 | 0.047 |

TABLE 1-continued

| Reagent | Reagent Injected Parts | Sulfur (%) |
|---|---|---|
| | 0.55 | 0.034 |
| | 0.73 | 0.027 |
| | 0.92 | 0.014 |
| | 1.12 | 0.010 |
| C | 0.0 | 0.062 |
| | 0.22 | 0.057 |
| | 0.43 | 0.040 |
| | 0.68 | 0.032 |
| | 0.93 | 0.029 |
| | 1.13 | 0.009 |
| | 1.37 | 0.005 |
| D | 0.0 | 0.053 |
| | 0.2 | 0.048 |
| | 0.4 | 0.033 |
| | 0.58 | 0.023 |
| | 0.78 | 0.014 |
| | 0.98 | 0.010 |
| | 1.18 | 0.005 |
| | 1.37 | 0.005 |
| D | 0.0 | 0.034 |
| | 0.2 | 0.025 |
| | 0.38 | 0.017 |
| | 0.58 | 0.006 |
| | 0.78 | 0.004 |
| | 0.98 | 0.003 |
| | 1.18 | 0.002 |
| | 1.37 | 0.001 |
| E | 0.0 | 0.033 |
| | 0.21 | 0.027 |
| | 0.42 | 0.022 |
| | 0.63 | 0.015 |
| | 0.84 | 0.007 |
| | 1.12 | 0.006 |
| | 1.32 | 0.003 |
| | 1.43 | 0.00 |
| E | 0.0 | 0.052 |
| | 0.2 | 0.044 |
| | 0.41 | 0.031 |
| | 0.62 | 0.023 |
| | 0.82 | 0.013 |
| | 1.03 | 0.008 |
| | 1.26 | 0.005 |
| | 1.48 | 0.003 |
| F | 0.0 | 0.068 |
| | 0.21 | 0.055 |
| | 0.42 | 0.042 |
| | 0.62 | 0.029 |
| | 0.83 | 0.020 |
| | 1.04 | 0.007 |

Notes:
Reagent A = 86% $CaC_2$ (technical) 9% Gilsonite 5% Magnesium
Reagent B* = 60% $CaC_2$ (technical) 40% Diamide lime (85% CaO/15% Carbon)
Reagent C* = 63% $CaC_2$ (technical) 21% CaO 11% Coal (40% volatiles) 5% Magnesium
Reagent D = 63% $CaC_2$ (technical) 25% CaO 7% Gilsonite 5% Magnesium
Reagent E = 69% $CaC_2$ 7% Gilsonite 5% Magnesium 19% CaO
Reagent F = 88% $CaC_2$ 7% Gilsonite 5% Magnesium
Note:
*Comparative As can be readily appreciated, the compositions containing gilsonite in accordance with the present invention are superior vis-a-vis the other comparative compositions which are representative of commercially available commodities.

EXAMPLE 2

Following the procedure of Example 1, except that the gilsonite component is replaced by grahamite, similar results are achieved.

EXAMPLE 3

The procedure of Example 2 is followed, replacing grahamite by manjak. Again, successful desulfurization occurs.

EXAMPLE 4

The procedure of Example 1 is repeated, except that the gilsonite compositions are composed of 83 percent lime, 1.5 percent gilsonite and 15.5 percent magnesium. Similar results are achieved.

EXAMPLE 5

A series of twenty-nine desulfurization runs is conducted at an iron refinery employing a lance injection technique substantially identical to that of Example 1. The reagent comprises:

68% Calcium carbide (technical)
22% Lime
5% Gilsonite
5% Magnesium

PRODUCTION RESULTS - TORPEDO LADLE PROCESS

| Metal Weight | Start Sulfur | Final Sulfur | Base CaD kg | Actual CMG kg | Factor |
|---|---|---|---|---|---|
| 148 | 0.042 | 0.003 | 1226 | 736 | 0.60 |
| 147 | 0.052 | 0.003 | 1381 | 829 | 0.60 |
| 132 | 0.039 | 0.004 | 1312 | 787 | 0.60 |
| 156 | 0.054 | 0.003 | 1503 | 902 | 0.60 |
| 131 | 0.053 | 0.003 | 1605 | 963 | 0.60 |
| 132 | 0.078 | 0.002 | 2213 | 1328 | 0.60 |
| 134 | 0.051 | 0.002 | 1243 | 726 | 0.58 |
| 144 | 0.033 | 0.001 | 1065 | 586 | 0.55 |
| 168 | 0.046 | 0.003 | 1464 | 766 | 0.52 |
| 164 | 0.043 | 0.002 | 1736 | 955 | 0.55 |
| 139 | 0.058 | 0.002 | 1822 | 1002 | 0.55 |
| 140 | 0.067 | 0.001 | 2060 | 1133 | 0.55 |
| 142 | 0.059 | 0.004 | 1887 | 1038 | 0.55 |
| 151 | 0.040 | 0.006 | 1220 | 671 | 0.55 |
| 135 | 0.032 | 0.004 | 1191 | 655 | 0.55 |
| 150 | 0.043 | 0.004 | 1258 | 692 | 0.55 |
| 143 | 0.057 | 0.007 | 1431 | 787 | 0.55 |
| 148 | 0.061 | 0.005 | 1547 | 851 | 0.55 |
| 147 | 0.044 | 0.003 | 1249 | 617 | 0.49 |
| 151 | 0.030 | 0.004 | 1075 | 591 | 0.55 |
| 142 | 0.039 | 0.005 | 1133 | 623 | 0.55 |
| 167 | 0.072 | 0.001 | 2020 | 1010 | 0.50 |
| 156 | 0.032 | 0.002 | 1139 | 570 | 0.50 |
| 126 | 0.052 | 0.005 | 1522 | 762 | 0.50 |
| 140 | 0.051 | 0.006 | 1668 | 834 | 0.50 |
| 156 | 0.036 | 0.003 | 1198 | 599 | 0.50 |
| 160 | 0.071 | 0.002 | 1911 | 956 | 0.50 |
| 156 | 0.037 | 0.004 | 1213 | 741 | 0.61 |
| 147 | 0.035 | 0.003 | 1115 | 558 | 0.50 |

Note:
1. Metal Wt. = Weight of iron treated in tons.
2. Start Sulfur = Percent sulfur in the iron prior to treatment.
3. Final Sulfur = Percent sulfur in the iron after treatment.
4. Base CaD = kilograms of Reagent B (Ex. 1) normally required for sulfur removal to 0.002 percent sulfur.
5. Actual CMG = kilograms of reagent used to remove sulfur to Final Sulfur level shown.
6. Factor = Act. CMG divided by Base CaD.

We claim:

1. An agent for the desulfurization of molten iron which is based on one of calcium carbide and lime and which is added fluidized form into an iron melt, said agent comprising one of calcium carbide and lime and an asphaltite.

2. An agent according to claim 1, further comprising magnesium.

3. An agent according to claim 1 comprising from about 0 percent to about 99.9 percent, by weight, based on the total weight of the agent, calcium carbide; from about 0.1 percent to about 40 percent, same basis, asphaltite; from about 0 percent to about 40 percent, same basis, magnesium and from about 0% to about 99.9 percent, same basis, lime.

4. An agent according to claim 1 comprising about 1 percent to about 98.9 percent, by weight, calcium carbide, from about 1 percent to about 98.9 percent, same basis, lime and from about 0.1 percent to about 40 percent, same basis, asphaltite.

5. An agent according to claim 1 comprising from about 60 percent to about 99.9 percent, by weight, of calcium carbide and from about 0.1 percent to about 40 percent, same basis, of an asphaltite.

6. An agent according to claim 1 wherein said asphaltite is gilsonite.

7. A process of desulfurizing molten iron which comprises adding to said molten iron an agent based on at least one of calcium carbide and lime and an asphaltite.

8. A process according to claim 7 wherein said agent comprises from about 0 percent to about 99.9 percent, by weight, calcium carbide, from about 0.1 percent to about 40 percent, same basis, asphaltite, from about 0 percent to about 40 percent, magnesium and from about 0 percent to about 99.9 percent, lime.

9. A process according to claim 7 wherein said agent comprises from about 1 percent to about 98.9 percent calcium carbide, from about 0.1 percent to about 40 percent asphaltite, and from about 1 percent to about 98.9 percent lime.

10. A process according to claim 7 wherein said agent comprises from about 60 percent to about 98.9 percent, by weight, calcium carbide and from about 0.1 percent to about 40 percent asphaltite.

11. A process according to claim 7 wherein said asphaltite is selected from the group consisting of gilsonite, grahamite and manjak.

12. An agent according to claim 3 wherein the components of the reagent are mixed uniformly with each other.

13. An agent according to claim 1 further comprising an additive to modify the characteristics of the slag generated from the reaction between the desulphurizing agent and the molten iron.

14. An agent according to claim 13 wherein said additive is at least one selected from the group consisting of fluorspar, alumina, magnesia, borox trioxide and borax.

15. An agent according to claim 1 further comprising an additional metallic component, said metallic component being added to modify the shape of the sulphide precipitates which result from the desulphurizing reaction.

16. An agent according to claim 15 wherein said additional metallic component is at least one selected from the group consisting of calcium metal, calcium silicon metal, individual rare earth metals and misch metal.

17. The process of claim 7 wherein said molten iron is disposed in a torpedo ladle.

18. The process of claim 7 wherein said molten iron is disposed in a transfer ladle.

19. An agent according to claim 3 wherein the components of the reagent are uniformly premised in any combination.

20. An agent according to claim 3 wherein the components of the reagent are separately stored and combined with the other components in fluidized form within the transport line or lance prior to injection into the molten iron.

21. An agent for the desulfurization of molten iron consisting of calcium carbide and an asphaltite, which is added in fluidized form into an iron melt.

22. An agent according to claim 21, further comprising magnesium.

23. An agent according to claim 22, wherein said asphaltite is selected from the group consisting of gilsonite, grahamite and manjak.

24. An agent according to claim 1, wherein said asphaltite is selected from the group consisting of gilsonite, grahamite and manjak.

* * * * *

UNITED STATES PATENT AND TRADEMARK OFFICE

CERTIFICATE OF CORRECTION

PATENT NO. : 5,284,504

DATED : February 8, 1994

INVENTOR(S) : Barker, Bruce J. et al.

It is certified that error appears in the above-identified patent and that said Letters Patent is hereby corrected as shown below:

Column 5, Table 1, last line of first example of Reagent E, "0.00" should be -- 0.002 --.

Signed and Sealed this

Sixth Day of September, 1994

*Attest:*

*Attesting Officer*

BRUCE LEHMAN

*Commissioner of Patents and Trademarks*